US007004569B2

(12) United States Patent
Mochizuki et al.

(10) Patent No.: US 7,004,569 B2
(45) Date of Patent: Feb. 28, 2006

(54) ELECTROTHERMAL CONVERTING ELEMENT BOARD, INK JET PRINTING HEAD PROVIDED WITH ELECTROTHERMAL CONVERTING ELEMENT BOARD AND INK JET PRINTING APPARATUS USING THE SAME

(75) Inventors: Muga Mochizuki, Kanagawa (JP); Ichiro Saito, Kanagawa (JP); Yoshiyuki Imanaka, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 40 days.

(21) Appl. No.: 10/655,269

(22) Filed: Sep. 3, 2003

(65) Prior Publication Data

US 2004/0070660 A1 Apr. 15, 2004

(30) Foreign Application Priority Data

Sep. 3, 2002 (JP) ..... 2002-258181

(51) Int. Cl.
*B41J 2/05* (2006.01)

(52) U.S. Cl. ..... 347/58; 347/64; 347/62

(58) Field of Classification Search ..... 347/61–65, 347/67, 57–59, 56, 20
See application file for complete search history.

(56) References Cited

U.S. PATENT DOCUMENTS 4,458,256 A * 7/1984 Shirato et al. ..... 347/58
4,990,939 A * 2/1991 Sekiya et al. ..... 347/62
6,443,563 B1 * 9/2002 Saito et al. ..... 347/65

FOREIGN PATENT DOCUMENTS

JP 62-48585 3/1987

* cited by examiner

*Primary Examiner*—Juanita D. Stephens
(74) *Attorney, Agent, or Firm*—Morgan & Finnegan, L.L.P.

(57) ABSTRACT

An individual electrode layer electrically connected to an individual electrode layer having an opening is formed beneath a heater layer and a common electrode layer along an ink flow path.

16 Claims, 7 Drawing Sheets

ELECTROTHERMAL CONVERTING ELEMENT BOARD, INK JET PRINTING HEAD PROVIDED WITH ELECTROTHERMAL CONVERTING ELEMENT BOARD AND INK JET PRINTING APPARATUS USING THE SAME

This application claims priority from Japanese Patent Application No. 2002-258181 filed Sep. 3, 2002, which is incorporated hereinto by reference.

BACKGROUND OF THE INVENTION

1. Field of the Invention

The present invention relates to an electrothermal converting element board provided with an electrothermal converting element having a plurality of heat generating sections arranged in correspondence to liquid flowing paths for guiding liquid used for the printing, an ink jet printing head provided with the electrothermal converting element board and an ink jet printing apparatus using the same.

2. Description of the Related Art

An ink jet printing apparatus generally has a printing head for ejecting ink used as a printing liquid. A bubble-jet (a registered trade mark) type printing head includes an ink ejection member having an ink ejection opening forming surface on which a plurality of ink ejection openings for ejecting ink droplets are formed at a predetermined distance, an electrothermal converting element board on which electrothermal converting elements are arranged in correspondence to each ink flow path in communication with the respective ink ejection opening in the ink ejection member, and a printed wiring board for supplying drive control signals to the respective electrothermal converting elements in the electrothermal converting element board (see. for example, Japanese Patent Application Publication No. 62-048585 (1987))

The ink ejection member has a common liquid chamber for storing a predetermined amount of ink supplied from an ink tank. The common liquid chamber communicates with one ends of the respective ink flow paths formed by opposite partitioning wall members arranged in parallel to each other. Thereby, ink is distributed from the common liquid chamber to the respective ink flow paths and ejected through the ink ejection opening as ink droplets.

As shown, for example, in FIGS. 7A and 7B, the electrothermal converting element board includes a base 6 disposed between a portion in which the ink flow paths of the ink ejection member are formed and the printed wiring board, and provided on one surface thereof closer to the ink flow paths with a heat generating section 8*a*i (i=1 to n; n is an integer) of a heater used as the electrothermal converting element and a heat generating section 20*a*i (i=1 to n; n is an integer) in correspondence to the respective ink flow path; an individual electrode layer 10 electrically connected at one end to the heat generating section 8*a*i; an individual electrode layer 18 arranged in the same plane as the individual electrode layer 10 and electrically connected at one end to the heat generating section 20*a*i; a common electrode layer 12 formed in the same plane as the individual electrode layers 10 and 18 and electrically connected at one end to the heat generating section 8*a* i and the heat generating section 20*a*i, respectively; a protective layer 16 for covering all the heat generating section 8*a*i, the heat generating section 20*a*i, the individual electrode layer 10 and the individual electrode layer 18 adjacent to each other; and an anti-cavitation layer 14 for covering all over the surface of the protective layer 16.

In this regard, in FIGS. 7A and 7B, part corresponding to two of all ink flow paths 2*a*i (i=1 to n; n is an integer) of the ink ejection member is solely illustrated as a representative and the other is omitted.

The heat generating section 8*a*i and the heat generating section 20*a*i are arranged on a common straight line along the ink flow path in the same plane as the base 6. The heat generating section 8*a*i is located at a position closer to the ink ejection opening of the ink ejection member than the position of the heat generating section 20*a*i. A capacity (a heat value) of the heat generating section 8*a*i is less than the capacity (a heat value) of the heat generating section 20*a*i.

To the other end of the common electrode layer 12 formed on the heat generating section 8*a*i, 20*a*i, a reference electric power source for supplying a predetermined electric power is connected.

The anti-cavitation layer 14 having undulations on a surface thereof has a shallow groove between the adjacent partitioning wall members 4*a*i (i=1 to n; n is an integer) of the ink ejection member and an elongate groove 14*a* in correspondence to the respective partitioning wall member 4*a*i. In this regard, the number of the ink ejection openings is recently liable to increase due to the requirement for the high resolution of the resultant printed image. Accordingly, a mutual distance between the adjacent heat generating sections 8*a*i and 20*a*i becomes relatively smaller.

One end of the partitioning wall member 4*a*i in the ink ejection member is brought into tight contact with the anti-cavitation layer 14 at a predetermined pressure so that the adjacent ink flow paths 2*a*i thus formed are independent from each other without communication. When a plurality of pairs of heat generating sections 8*a*i and 20*a* are formed in the respective ink flow paths and the individual electrode layers 10 and 18 and the common electrode layer 12 are arranged parallel to each other in the same plane as described above, wirings and routes of the wiring are relatively increased and complicated between the respective electrode layers and the reference electric power source.

Also, when the number of the ink ejection openings is increased, with the trend moving toward greater densities, it might be thought to reduce a width of the respective heaters and that of the individual electrode layers 10, 18 and the common electrode layer 12 so that a width of the respective ink flow path is narrower. There is a risk, however, if the width of the respective heater becomes narrower, in that the ink ejection reduces in performance as the heating efficiency becomes lower. Also, the reduction of the width of the individual electrode layers 10, 18 and the common electrode layer 12 has a limitation because the wiring resistance becomes larger. Accordingly, it is difficult to realize the greater-density of the heat generating sections in the electrothermal converting element board and the ink ejection openings as well as to miniaturize the electrothermal converting element board.

SUMMARY OF THE INVENTION

In view of the above problems, an object of the present invention is to provide an electrothermal converting element board having a plurality of electrothermal converting elements disposed in correspondence to liquid flowing paths for guiding liquid used for the printing, an ink jet printing head provided with the electrothermal converting element board, and an ink jet printing apparatus using the same, capable of realizing the greater-density of the heat generating sections in the electrothermal converting element board and the ink ejection openings as well as to miniaturize the electrothermal converting element board, without lowering the ink ejection performance.

To achieve the above-mentioned object, the electrothermal converting element board according to the present invention comprises a common electrode layer formed, via a first insulating layer, beneath an electrothermal converting element layer having a plurality of heat generating sections arranged on one straight line in correspondence to a plurality of liquid flowing paths, each having a liquid ejection opening for ejecting liquid used for the printing at one end thereof; the common electrode layer being electrically connected to the plurality of heat generating sections; an individual electrode layer electrically connected to at least one of the heat generating sections and disposed, via a second insulating layer, beneath the common electrode layer and the electrothermal converting element layer, and a board section provided with the electrothermal converting element layer, the common electrode layer and the individual electrode layer.

The ink jet printing head provided with the electrothermal converting element board according to the present invention comprises a liquid ejection member having a plurality of liquid flowing paths, each having a liquid ejection opening at one end thereof for ejecting liquid used for the printing, a common electrode layer disposed via a first insulating layer beneath an electrothermal converting element layer having a plurality of heat generating sections arranged on one straight line in correspondence to a plurality of liquid flowing paths, each having a liquid ejection opening for ejecting liquid used for the printing at one end thereof; the common electrode layer being electrically connected to the plurality of heat generating sections; an individual electrode layer electrically connected to at least one of the heat generating sections and disposed via a second insulating layer beneath the common electrode layer and the electrothermal converting element layer, an electrothermal converting element board provided with a plurality of electrothermal converting elements, a board section having the electrothermal converting element layer, the common electrode layer and the individual electrode layer, and a circuit board electrically connected to the electrothermal converting element board for supplying electric power to the common electrode layer of the electrothermal converting element board.

Further, the ink jet printing apparatus according to the present invention comprises the above-mentioned ink jet printing head carrying out the printing operation of a printing surface of a printing medium, printing head moving means for moving the ink jet printing head relative to the printing surface of the printing medium, and a control section for operating the printing head moving means to relatively move the ink jet printing head and for operating the printing head to carry out the printing operation.

As apparent from the above description, according to the electrothermal converting element board, the ink jet printing head provided with the electrothermal converting element board and the ink jet printing apparatus using the same of the present invention, since the individual electrode layer electrically connected to at least one of the plurality of heat generating sections is formed beneath the common electrode layer and the electrothermal converting element layer via the second insulating layer, while the common electrode layer electrically connected to the respective heat generating sections is formed beneath the electrothermal converting element layer having a plurality of heat generating sections arranged on a straight line in correspondence to a plurality of liquid flowing paths, and formed on the board section via the first insulating layer, it is possible to ensure the sufficient heat generating area of the electrothermal converting element layer, simplify the wiring as well as reduce the width of the liquid flowing path. Thus, the greater-density of the heat generating sections in the electrothermal converting element board and the ink ejection openings is realized and the electrothermal converting element board becomes smaller in size.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Figure 3:
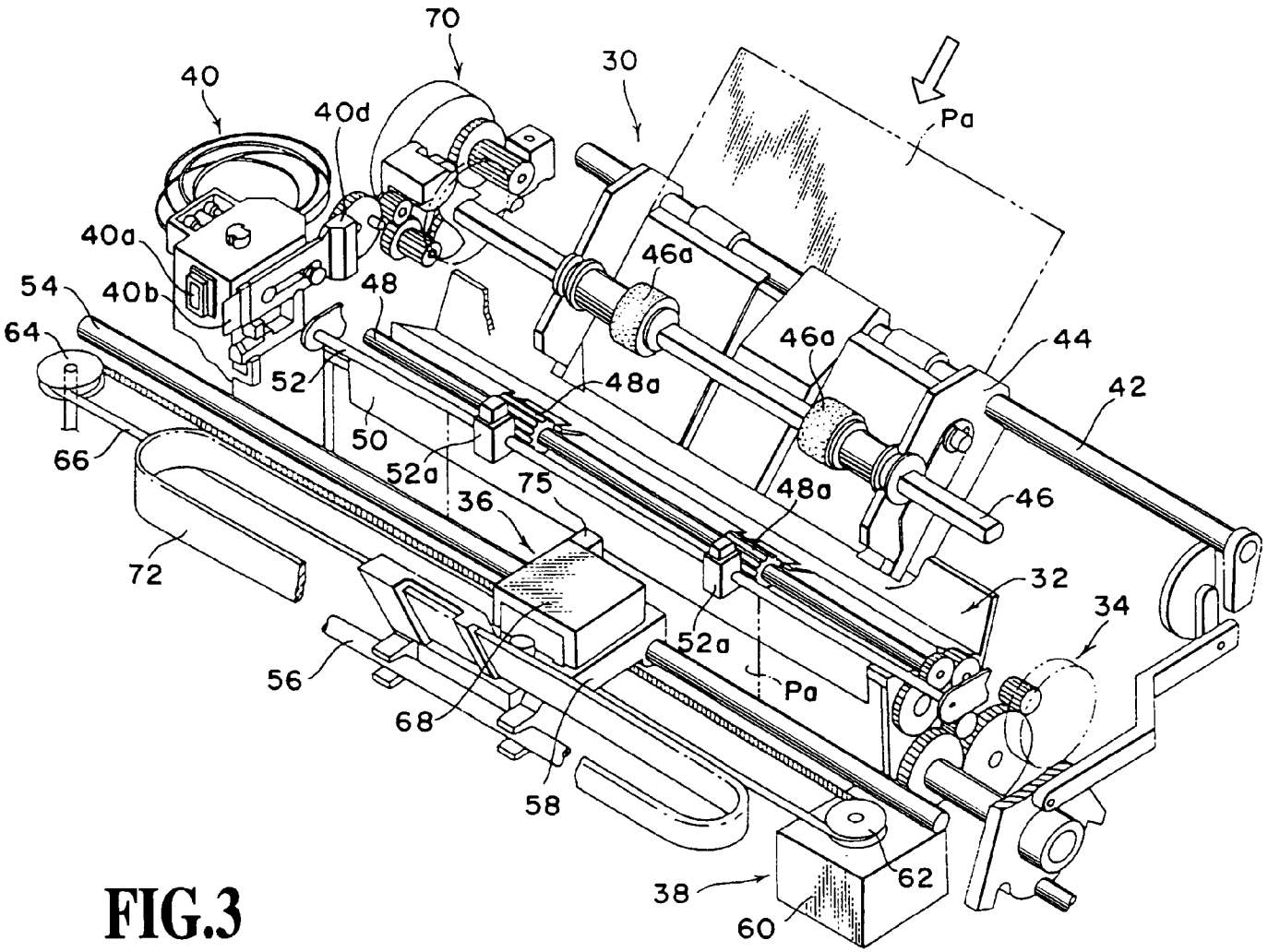
FIG. 3 is a perspective view illustrating an ink jet printing apparatus provided with a printing head using the embodiment of the electrothermal converting element board according to the present invention.

FIG. 3 illustrates a important part of an embodiment of the ink jet printing apparatus according to the present invention.

In FIG. 3, the apparatus includes a sheet feeding section 30 for delivering a paper sheet Pa one by one from a stack of printing media stored therein, a printing medium conveying section 32 for conveying the paper sheet Pa delivered from the sheet feeding section 30 to a printing section 36 described later, and a printing section 36 for carrying out the printing operation on a printing surface of the paper sheet Pa conveyed and made to stop at a predetermined position.

The sheet feeding section 30 includes a sheet feeding tray 44 for storing a plurality of paper sheets Pa, a rotary shaft 46 disposed opposite to the sheet feeding tray 44 and having two pickup rollers 46*a* for delivering the topmost paper sheet Pa in the stack stored in the sheet feeding tray 44, and a drive device 70 for rotating the rotary shaft 46.

The sheet feeding tray 44 is supported by a supporting shaft 42 disposed in a housing not shown and inclined to point toward upstream from a conveying passage of the printing medium conveying section 32. The rotary shaft 46 extends in the direction transverse to the conveying direction of the paper sheet Pa (the direction shown by an arrow in FIG. 3) and is supported for rotation on the periphery of the paper feeding tray 44. One end of the rotary shaft 46 is coupled to a speed reduction mechanism of the drive device 70.

The drive device 70 includes a drive motor and a speed reduction mechanism coupled to an output shaft of the motor. The drive motor is controlled by a drive control signal issued from a motor drive control section 108 described later. The speed reduction mechanism includes, for example, a gear train and selectively switches between routes for transmitting the power to a recovery device 40 and for transmitting the power to one end of the rotary shaft 46. The switching control of the transmission routes of the speed reduction mechanism is selectively carried out by a switching control signal issued from a control unit.

The printing medium conveying section 32 includes a conveyor roller (not shown in FIG. 3) disposed transverse to the conveying direction of the paper sheet Pa in the conveying passage into which the paper sheet Pa is introduced, a rotary shaft 48 disposed opposite to the conveyor roller and having nip rollers 48*a* for conveying the paper sheet Pa while being associated with the conveyor roller, a platen member 50 disposed opposite to a printing head 75 of the printing section 36 for maintaining the printing surface of the conveyed paper sheet Pa flat, a plurality of pressing members 52*a* for pressing the paper sheet Pa onto the platen member 50, and a drive mechanism section 34 for rotating the conveyor roller and the rotary shaft 48.

One ends of the conveyor roller and the rotary shaft 48 are coupled to a gear train of a drive mechanism 34, for example, via a gear. The drive mechanism 34 includes a drive motor and a gear mechanism coupled to an output shaft of a drive motor. The drive motor is controlled based on a drive control signal issued from the motor drive control section 108.

The recovery device 40 is provided at a predetermined position (a home position) of the other end portion of the conveyor roller and the rotary shaft 48, for carrying out the recovery treatment of the printing head 75 in the printing section 36.

The recovery device 40 includes a capping member 40*a* capable of approaching the printing head 75 located at a predetermined waiting position to be in an engagement state or going away from the printing head 75 to be in a non-engagement state, and a blade holding member 40*d* having a blade member 40*b* for wiping off ink or others adhered to an ink ejection opening forming surface of the printing head 75, and a moving mechanism for advancing or retreating the capping member 40*a* relative to the printing head 75.

The capping member 40*a* has an engagement section capable of being in tight contact with the ink ejection opening forming surface of the printing head 75 when approaching the printing head 75. The engagement section is coupled to a suction device not shown. When the engagement section of the capping member 40*a* is brought into tight contact with the ink ejection opening forming surface of the printing head 75, the suction device is in an operative state in which the ink ejection opening in the ink ejection opening forming surface of the printing head 75 is sucked. According to this recovery treatment, an accident is avoidable in that the ink is not ejected. At this time, the preliminary ink ejection may be carried out from the ink ejection opening of the printing head 75 to the engagement section.

The blade member 40*b* of the blade holding member 40*d* is made, for example, of rubber-like material. The blade member 40*b* is disposed between the capping member 40*a* and the other ends of the conveyor roller and the rotary shaft 48, and adapted to follow the operation of the capping member 40*a* at a predetermined timing via a moving mechanism not shown. Thereby, when the printing head 75 moves to a printing area of the paper sheet Pa after the printing head 75 has been recovered by the capping member 40*a,* ink or others adhered to the ink ejection opening forming surface of the printing head 75 is wiped off by a tip end of the blade member 40*b*.

The printing section 36 includes the printing head 75 and an ink tank 68, a carriage member 58 to which the printing head 75 and the ink tank 68 are detachably mounted, and a carriage conveying/driving section 38 for reciprocating the carriage member 58.

The carriage member 58 is slidably supported for rotation by a guide shaft 54 disposed generally parallel to the platen member 50 and a guide shaft 56 disposed generally parallel to the guide shaft 54. Opposite ends of the guide shafts 54 and 56 are supported by supporting members of the housing not shown. Also, a lower portion of the carriage member 58 is coupled to a timing belt 66.

The carriage conveying/driving section 38 includes a drive motor 60, the timing belt 66, and a pair of pulleys 62 and 64, around which is wrapped the timing belt 66 along the guide shaft 54. The drive motor 60 is, for example, a stepping motor controlled by drive control data issued from a control unit 106.

The pulleys 62 and 64 are arranged opposite to each other at a predetermined distance. The pulley 62 is coupled to an output shaft of the drive motor 60, and the pulley 64 is fixed to one end of a rotary shaft supported for rotation by the housing. Accordingly, when the drive motor 60 is operated, the carriage member 58 coupled to the timing belt 66 moves at a predetermined distance together with the printing head 75.

One end of a flexible cable 72 is connected to the printing head 75, for supplying drive control data issued from the control unit 106 to a printed wiring board 74 described later.

Figure 4:
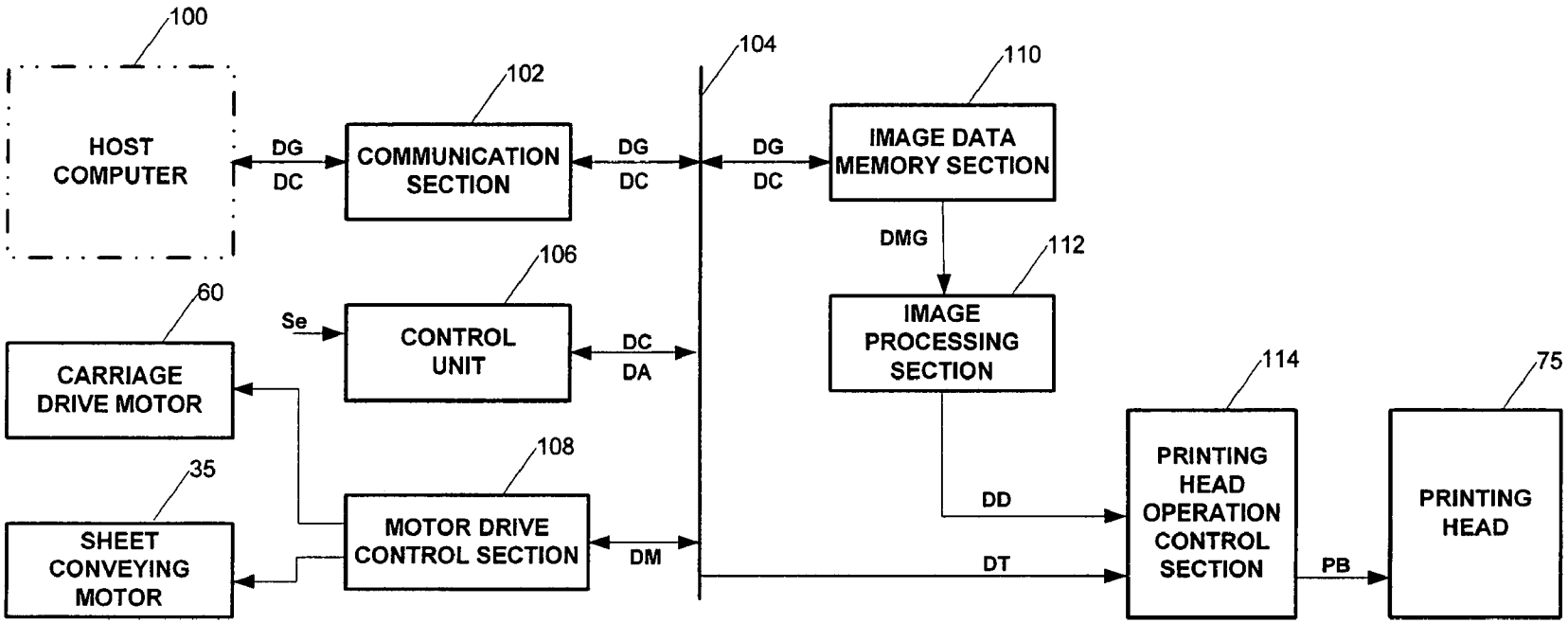
FIG. 4 is a block diagram of a control block incorporated in the embodiment shown in FIG. 3.

Further, one embodiment of the inventive ink jet printing apparatus is provided with a control block including a printing head operation control section 114 for controlling the operation of the printing section 36 as shown in FIG. 4.

The control block includes, as main constituent elements, a communication section 102 supplied with image data DG and control data DC from a host computer 100 provided separately from the ink jet printing apparatus, an image data memory section 110 for selectively storing the image data DG transferred from the communication section 102 via a transmission path 104 and selectively transmitting the stored image data DG, an image processing section 112 for obtaining a printing operation control data group DD by carrying out the data conversion process of image data DMG read from the image data memory section 110, and the control unit 106 for carrying out the operation control of the image data memory section 110, the image processing section 112, the motor drive control section 108 and the printing head operation control section 114 via the transmission path 104.

The communication section 102 includes, for example, an interface circuit (IEEE1284), and becomes a reception state when the image data DG and the control data DC corresponding to a single scan or a predetermined number of scans are supplied from the host computer 100. While, the communication section 102 becomes a transmission state for transmitting data representing a memory capacity of the image data memory section 110 to the host computer 100 when the above-mentioned data is supplied from the control unit 106.

The control unit 106 supplies a control data group DM for subjecting the carriage drive motor 60 and the sheet conveying motor 35 to the predetermined operation based on the control data DC obtained via the transmission path 104. The control unit 106 also forms and transmits ejection timing data DT for the printing head 75 in synchronism with the movement of the carriage member 58, based on a detection signal Se output from an encoder section provided on the carriage member 58.

The motor drive control section 108 forms a drive control signal based on the control data group DM and supplies the same to the carriage drive motor 60 to reciprocate the carriage member 58 at a predetermined distance, and forms a drive control signal based on the control data group DM and supplies the same to the sheet conveying motor 35 to intermittently convey the paper sheet Pa at a predetermined distance in accordance with the printing operation of the printing section 36.

The image data memory section 110 is adapted so that one pixel has a predetermined number of bits, for example, and the supplied image data DG are subsequently written in the indicated memory address. Also, the image data memory section 110 supplied the image data DMG of one scan stored in the indicated memory address to the image processing section 112.

The image processing section 112 includes, for example, a multiple value/binary value converting section for binarizing the image data DMG supplied from the image data memory section 110, a signal distributing section for distributing the binarized data from the multiple value/binary value converting section to the printing head 75, and a registration adjusting section for carrying out the raster conversion for arranging the binarized data distributed from the signal distributing section to be in coincidence with the arrangement of the ink ejection openings in the printing head 75 as well as carrying out the registration adjustment and outputting the printing operation control data group DD to the printing head operation control section 114.

The printing head operation control section 114 forms a drive control pulse signal PB in synchronism with the ejection timing data DT issued from the control unit 106 based on the printing control data group DD when the printing head 75 and the carriage member 58 moves, so that the printing head 75 carries out the printing operation, and supplies the same to the printing head 75.

Thereby, the printing head 75 carries out the printing operation on the printing surface of the paper sheet Pa.

Figure 2:
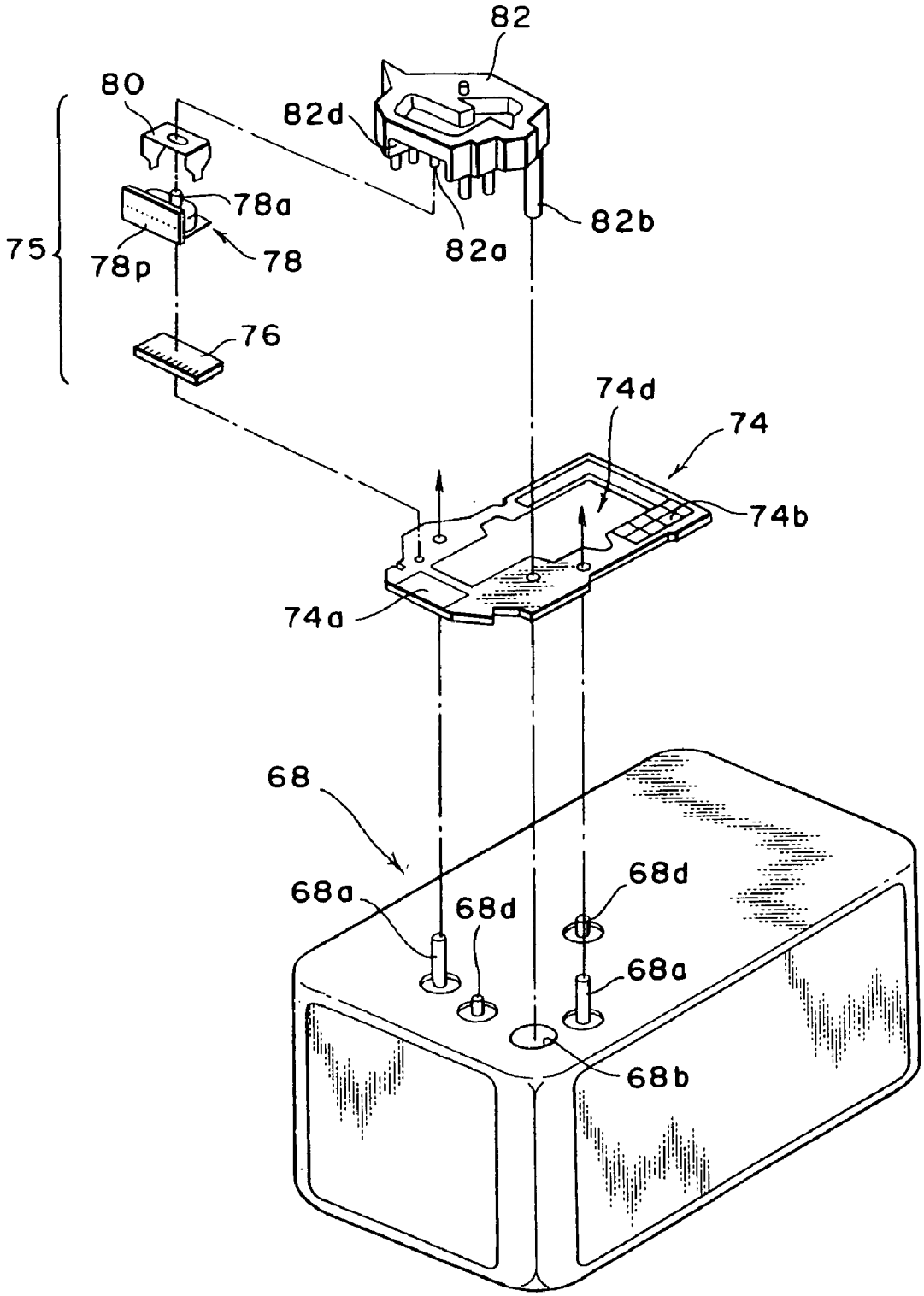
FIG. 2 is an exploded perspective view of an ink cartridge provided with a printing head using the embodiment of the electrothermal converting element board according to the present invention.

As shown in FIG. 2, the printing head 75 includes as main constituent elements, for example, an electrothermal converting element board 76 which is one embodiment of the present invention, an ink ejection member 78, a pressing spring 80 for pressing the ink ejection member 78 to the electrothermal converting element board 76, an ink supply/distribution member 82 for supply and distributing ink to the ink ejection member 78, and the printed wiring board 74.

The printed wiring board 74 has an electrode surface section 74*a* to which the electrothermal converting element board 76 is fixed, a circuit section 74*d* electrically connected to the electrode surface section 74*a*, for outputting the drive control signal group thereto, and contact pads 74*b* electrically connected to the aforementioned flexible cable 72 and the circuit section 74*d*, for outputting the drive control signal group to the circuit section 74*d*.

The printed wiring board 74 is fixed to one end surface of the ink tank 68 described later by a pair of fixing shafts 68*a* provided on the end surface of the ink tank 68 and inserted into through-holes thereof via a coupling member not shown. Also, the printed wiring board 74 is located at a predetermined position in the end surface of the ink tank 68 by the engagement of the coupling members with a pair of positioning members 68*d* provided on the end surface of the ink tank.

The ink supply/distribution member 82 has a supply path 82*b* connected to a supply path 68*b* of the ink tank 68 via through-holes of the printed wiring board 74 and the coupling member, and a supply path 82*a* in interior communication with the supply path 82*b* and connected to a coupling section 78*a* of the ink ejection member 78. Also, the ink supply/distribution member 82 has an engagement section 82*d* at a position in correspondence to the electrode surface 74*a* of the printed wiring board 74, for gripping the periphery of the ink ejection opening forming surface of the ink ejection member 78 in association with a pressing spring 80 and the electrothermal converting element board 76.

The ink ejection member 78 has a common liquid chamber in communication with the coupling section 78*a* coupled to the supply path 82*a* of the ink supply/distribution member 82. The common liquid chamber has a capacity for storing a predetermined amount of ink and communicated to one each ends of a plurality of ink flow paths. As shown in FIG. 5B, the respective ink flow path 78*b*i (i=1 to n; n is an integer) is formed by two partitioning wall members 78*a*i (i=1 to n; n is an integer) provided opposite to each other at the portion facing the electrothermal converting element board 76 and the electrothermal converting element board 76, to be parallel to the other at a predetermined distance.

The ink ejection opening is formed at the other end of the respective ink flow path 78*b*i. The ink ejection openings are arranged along one straight line on the ink ejection opening forming surface 78*p* of the ink ejection member 78 at a predetermined distance.

Figure 1:
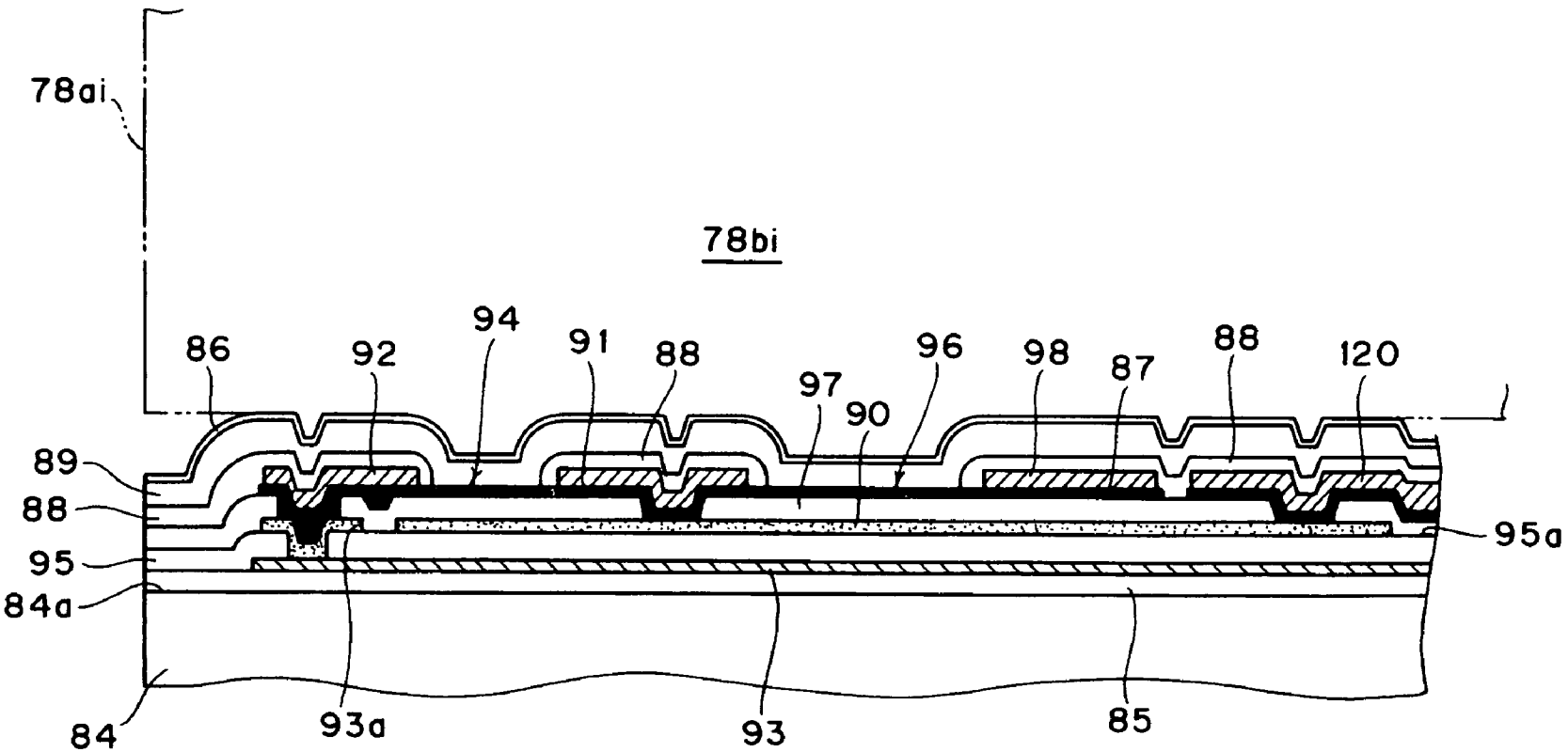
FIG. 1 is a partial sectional view showing important part of one embodiment of the electrothermal converting element board according to the present invention.

As shown in FIGS. 1 and 5B, the electrothermal element board 76 of a first embodiment of electrothermal element board according to the present invention includes, for example, a base 84 made of silicon and fixed to the electrode surface 74*a* of the printed wiring board 74, heat generating sections 94 and 96 of a heater layer 87 provided as an electrothermal converting element layer in correspondence to the respective ink flow path 78*b*i on an end surface of the base 84 closer to the ink flow path 78*b*i, a common electrode layer 90 connected to the heater layer 87 between the heat generating sections 94 and 96 to supply the electric power to them, individual electrode layers 92 and 98 connected at one end to the heat generating sections 94 and 96, the heat generating sections 94 and 96, and an anti-cavitation layer 86 covering common electrode layer 90 and the individual electrode layers 92, 98 via a protective layer 88.

Figure 5A:
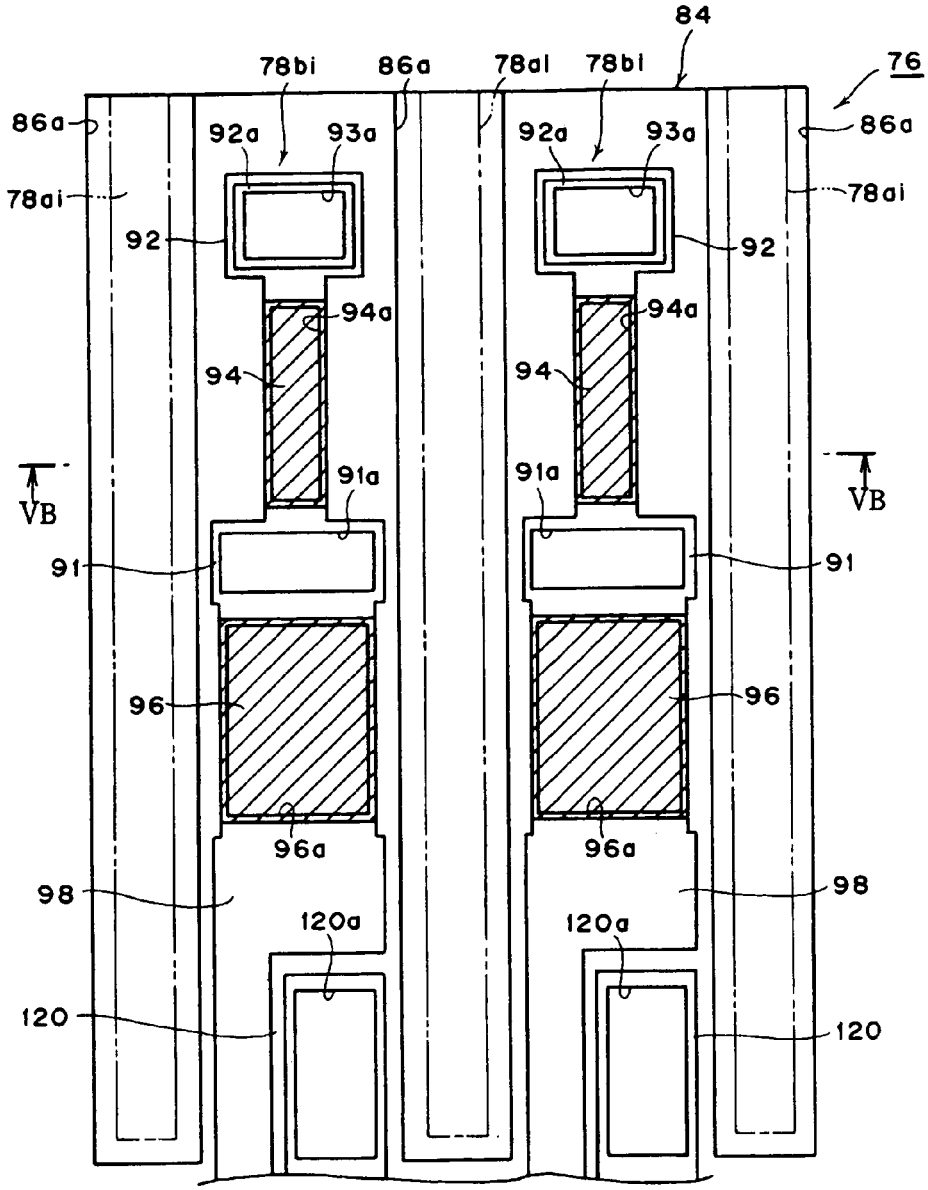
FIG. 5A is a sectional view of a important part of a first embodiment the electrothermal converting element board according to the present invention.
Figure 5B:
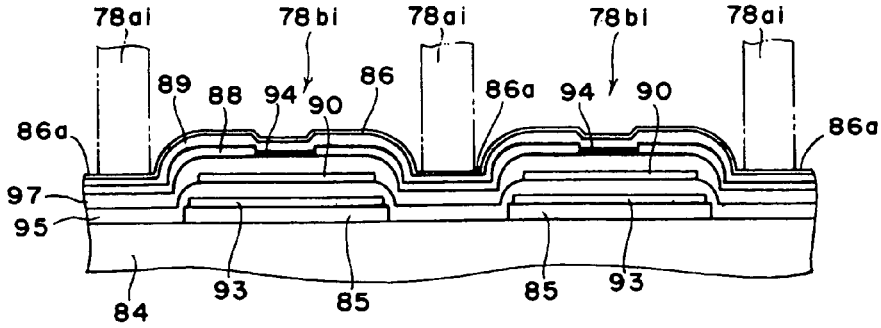
FIG. 5B is a partial sectional view taken along a line VB—VB in FIG. 5A.

In this regard, in FIGS. 1 and 5A, 5B, part of the plurality of ink flow paths 78*b*i is illustrated as a representative, while eliminating the other.

The base 84 of a generally rectangular shape is formed, for example, to a sheet form of approximately 625 $\mu$m in thickness.

As shown in FIGS. 1 and 5B, on an upper surface 84*a* formed on the base 84, an individual electrode layer 93 electrically connected via an insulating layer 85 to the individual electrode layer 92 having an opening 92*a* extends along the ink flow path 78*b*i to a position beneath the individual electrode layer 92. An end portion of the individual electrode layer 93 in the vicinity of the ink ejection opening of the ink flow path is connected via a connecting conductor section 93*a* to the heater layer 87 and the individual electrode layer 92 located thereabove. The entirety of the individual electrode layer 93 is covered with an insulating layer 95.

On an upper surface 95*a* of the insulating layer 95, the common electrode layer 90 formed opposite to the individual electrode layer 93. One end of the common electrode layer 90 extends closer to the connecting conductor section 93*a*.

A middle portion of the common electrode layer 90 is electrically connected to an area of the heater layer 87 between the heat generating sections 94 and 96 and to a common electrode bifurcate section 91 having an opening 91*a* via an insulating layer 97. An end portion of the common electrode layer 90 away from the ink ejection opening of the ink flow path is electrically connected to a common electrode layer 120 to be connected to a reference electric power source not shown.

As shown in FIG. 5A, the common electrode layer 120 extends parallel to the individual electrode layer 98 at a predetermined gap while being formed in correspondence to the ink flow path 78*b*i. The common electrode layer 120 has a width narrower than that of a portion of the individual electrode layer 98 to be connected to the heater layer 87 and that of the common electrode layer 90 along the ink flow path 78*b*i. The common electrode layer 120 has an opening 120*a* in a central area thereof.

The heater layer 87 is made, for example, of hafnium boride. Also, the heat generating sections 94 and 96 thereof are disposed on a common straight line along the ink flow path 78*b*i on the base 84 at a predetermined distance. In this regard, in the ink flow path 78*b*i, the heat generating section 94 is formed closer to the ink ejection opening than the heat generating section 96. A heat value of the heat generating section 94 is smaller than that of the heat generating section 96.

A side of the heat generating section 96 disposed above the common electrode layer 90 away from the common electrode bifurcate section 91 is connected to the individual electrode layer 98. The thickness of the individual electrode layers 92 and 98 are generally identical to each other, and made, for example, of aluminum having a thickness of approximately 0.2 to 1.0 $\mu$m.

The common electrode layer 90 and the common electrode bifurcate section 91 may be made, for example, of the same material as the individual electrode layers 92 and 98 to have the same thickness thereof.

All of the insulating later 97, the individual electrode layers 92 and 98, the common electrode bifurcate section 91 and the common electrode layer 120 are covered with the protective layers 88 as a whole. For example, the protective layer 88 is made of silicon nitride or silicon oxide having a thickness of approximately 1.0 $\mu$m. The respective protective layer 88 is further covered with a protective layer 89 as a whole.

A thickness of heater protective layers 94*a* and 96*a* covering the upper surface of the heat generating sections 94 and 96 in the protective layer 89 is thinner than that of the protective layers 88 and 89 covering the individual electrode layer 92 or others.

Accordingly, the thermal conductivity of the heater protective layers 94*a* and 96*a* covering the upper surface of the heat generating sections 94 and 96 becomes higher than in a case wherein the former are covered with the protective layers 88 and 89 having an equal thickness to improve the heating efficiency of the heat generating sections 94 and 96. In this regard, areas of the heater protective layer 94*a* and 96*a* are slightly smaller than surface areas of the heat generating sections 94 and 96, respectively.

The protective layer 89 is covered with the anti-cavitation layer 86. This anti-cavitation layer 86 is made, for example, of tantalum having a thickness of approximately 0.2 $\mu$m.

Between adjacent each ink flow path 78*b*i in the anti-cavitation layer 86, a recess 86*a* for restricting a relative position of the partitioning wall member 78*ai* to the common electrode bifurcate section 91, the individual electrodes 92 and the individual electrodes 98 is formed in correspondence to the partitioning wall member 78*a*i. The recess 86*a* has a depth of approximately 1.0 $\mu$m and a width corresponding to a thickness of the partitioning wall member 78*a*i.

As shown in FIG. 5B, in an area between the adjacent ink flow paths 78*b*i, the protective layers 88 and 89 having an equal thickness are continuously formed along the periphery of the recess 86*a* in the anti-cavitation layer 86 without forming a step height each other between the ink flow paths 78*b*i.

Thus, since the ink ejection member 78 is assembled with the electrothermal converting element board 76 in a state in which the lower end surface of the respective partitioning wall member 78*a*i of the ink ejection member 78 is assuredly brought into tight contact with the bottom of the recess 86*a* in the anti-cavitation layer 86 of the electrothermal converting element board 76, the ink leakage between the respective ink flow paths 78*b*i is assuredly avoidable.

Also, since the respective individual electrode layer 93 is disposed beneath the common electrode layer 90 in a range within a width of the respective ink flow path 78*b*i, it is possible to furthermore reduce a distance between the ink flow paths 78*b*i. Accordingly, the greater-density of the ink ejection openings and the ink flow paths 78*b*i are achievable.

Figure 6A:
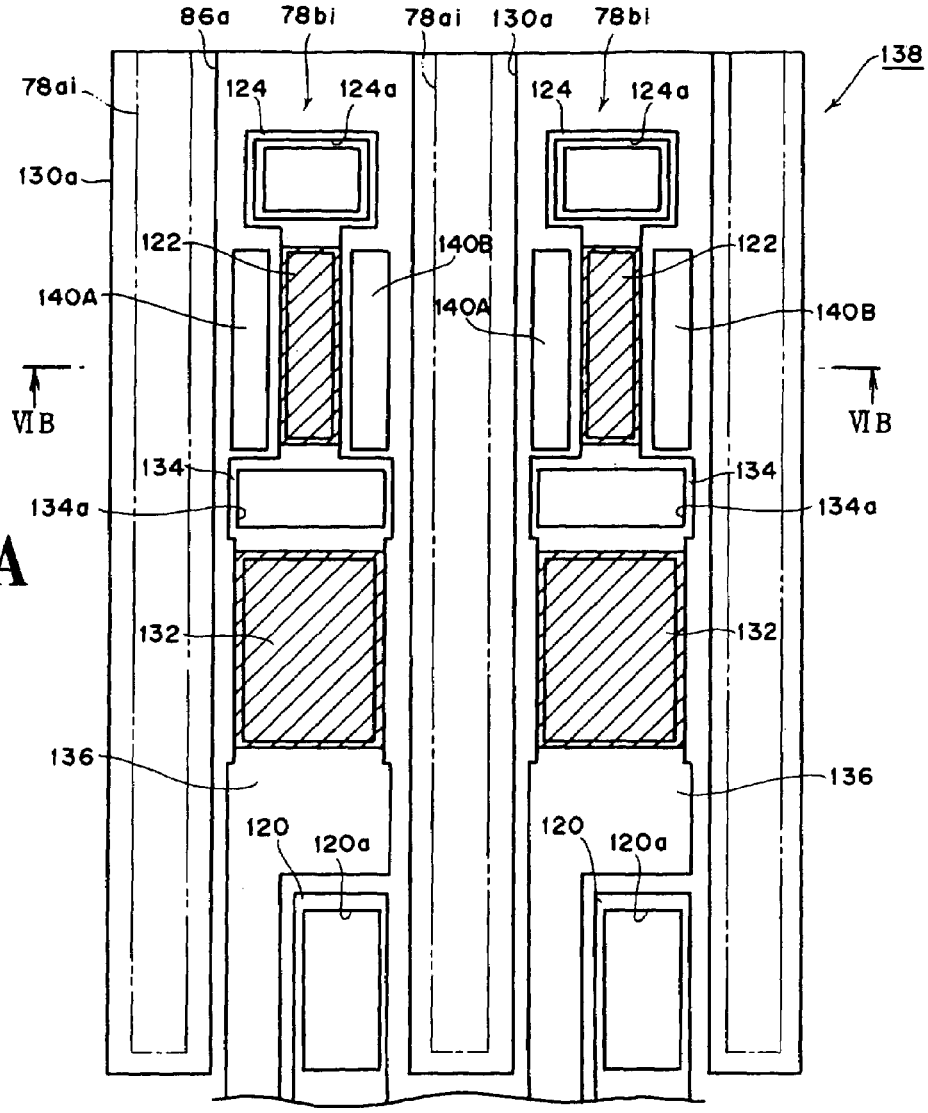
FIG. 6A is a sectional view of a important part of a second embodiment the electrothermal converting element board according to the present invention.
Figure 6B:
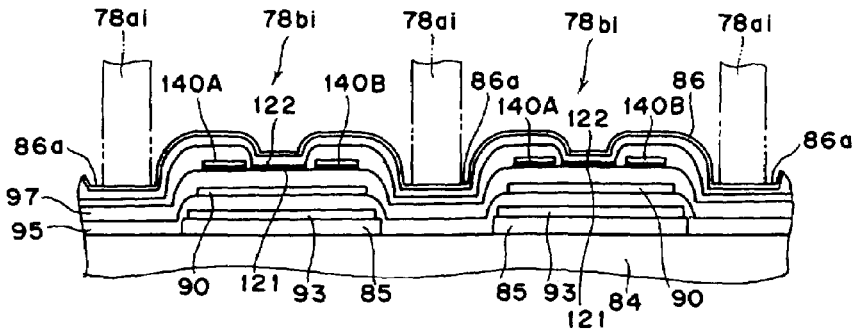
FIG. 6B is a partial sectional view taken along a line VIB—VIB in FIG. 6A.
Figure 7A:
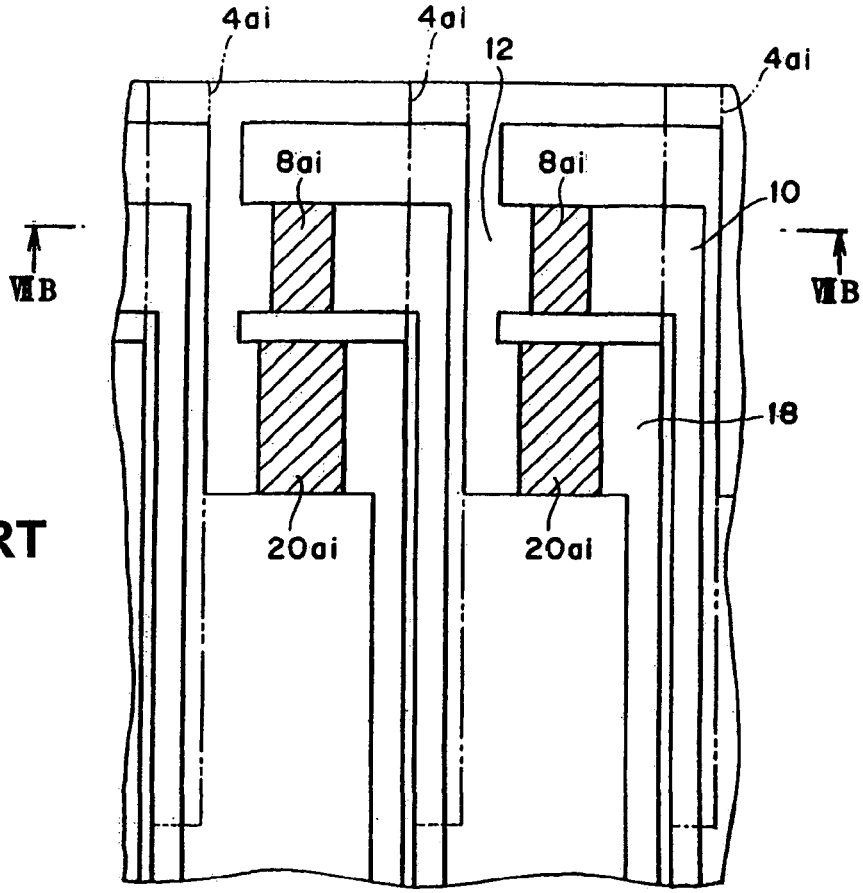
FIG.7A PRIOR ART
FIG. 7A is a sectional view of a important part of the conventional electrothermal converting element board.
Figure 7B:
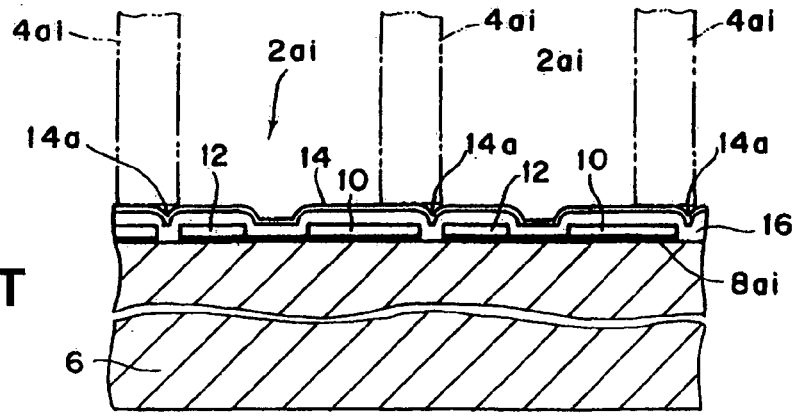
FIG.7B PRIOR ART
FIG. 7B is a partial sectional view taken along a line VIIB—VIIB in FIG. 7A.

FIGS. 6A and 6B illustrate a important part of the electrothermal converting element board according to a second embodiment of the present invention.

The embodiment shown in FIGS. 6A and 6B is an electrothermal converting element board 138 in which electrode layer 140A and 140B are formed in a space between the respective sides of the heat generating section 122 of the heater layer 121 and the respective partitioning wall members 78*a*i, respectively.

In this regard, in FIGS. 6A and 6B, the same reference numerals are used for denoting the same constituent elements in an embodiment shown in FIGS. 5A and 5B and the overlapping explanation thereof will be eliminated.

The electrode layers 140A and 140B are formed in the same plane as the individual electrode layer 124, while maintaining a predetermined gap from the heat generating section 122 and the individual electrode layer 124 having an opening 124*a* in a central area thereof, respectively.

Since the electrode layers 140A and 140B are formed in a space between the respective sides of the heat generating section 122 of the heater layer 121 and the respective partitioning wall members 78*a*i, the depth of the recess 86*a* formed in the electrothermal converting element board 138 corresponding to the heat generating section 122 is deeper than that of the recess in the electrothermal converting element board having no electrode layers 140A and 140B as shown in the first embodiment.

Accordingly, in the ink jet printing head according to this embodiment, the greater-density of the ink ejection openings and the ink flow paths 78*b*i are achievable as in the case of the first embodiment. Further, the ink leakage between the respective ink flow paths 78*bi* is more assuredly avoidable than the first embodiment.

Though the electrode layers 140A and 140B are not electrically connected to the heat generating section 122 and the individual electrode layer 124 in this embodiment, the same effect as in the preceding embodiment is achievable in a case where the electrode layers 140A and 140B are electrically connected to the heat generating section 122 and the individual electrode layer 124.

While the present invention is applied to the ink jet printing head 75 ejecting ink in the above-mentioned embodiments, the present invention should not be limited thereto but may be applied, for example, to a printing head 75 ejecting treatment liquid for insolubilizing an ink dye.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. An electrothermal converting element board comprising:

an electrothermal converting element layer having a plurality of heat generating sections arranged on one straight line in correspondence to a plurality of liquid flowing paths, each having a liquid ejection opening for ejecting liquid used for a printing at one end thereof;

a common electrode layer connected to said plurality of heat generating sections of said electrothermal converting element layer, wherein said common electrode layer is formed via a first insulating layer beneath said plurality of heat generating sections of said electrothermal converting element;

an individual electrode layer electrically connected to at least one of said plurality of heat generating sections of said electrothermal converting element layer and formed beneath said common electrode layer via a second insulating layer; and a base section that supports said electrothermal converting element layer, said common electrode layer and said individual electrode layer, wherein said first insulating layer, said common electrode layer, said second insulating layer and said individual electrode layer are laminated in sequence beneath said heat generating sections.

2. An electrothermal converting element board comprising:

an electrothermal converting element layer having a plurality of heat generating sections arranged on one straight line in correspondence to a plurality of liquid flowing paths, each having a liquid ejection opening for ejecting liquid used for printing at one end thereof;

a common electrode layer connected to said plurality of heat generating sections of said electrothermal converting element layer, wherein said common electrode layer is formed via a first insulating layer beneath said plurality of heat generating sections of said electrothermal converting element layer;

an individual electrode layer electrically connected to at least one of said plurality of heat generating sections of said electrothermal converting element layer and formed beneath said common electrode layer via a second insulating layer;

a protective layer for covering said plurality of heat generating sections of said electrothermal converting element layer, said common electrode layer and said individual electrode layer; and a base section that supports said electrothermal converting element layer, said common electrode layer and said individual electrode layer, wherein a thickness of a portion of said protective layer covering said plurality of heat generating sections is smaller than that of a portion of said protective layer covering said individual electrode layer, wherein said first insulating layer, said common electrode layer, said second insulating layer and said individual electrode layer are laminated in sequence beneath said heat generating sections.

3. An ink jet printing head comprising:

a liquid ejection member having a plurality of liquid flowing paths, each having a liquid ejection opening at one end thereof for ejecting liquid used for a printing;

an electrothermal converting element board comprising an electrothermal converting element layer having a plurality of heat generating sections arranged on one straight line in correspondence to a plurality of liquid flowing paths, each having a liquid ejection opening for ejecting liquid used for a printing at one end thereof, a common electrode layer, wherein said common electrode layer is formed via a first insulating layer beneath said plurality of heat generating sections of said electrothermal converting element layer, an individual electrode layer electrically connected to at least one of the plurality of heat generating sections of the electrothermal converting element layer and formed beneath said common electrode layer via a second insulating layer, a board section provided with said electrothermal converting element layer, said common electrode layer and said individual electrode layer, wherein said first insulating layer, said common electrode layer, said second insulating layer and said individual electrode layer are laminated in sequence beneath said heat generating sections; and a wiring board electrically connected to said electrothermal converting element board for supplying electric power to said common electrode layer of said electrothermal converting element board.

4. An ink jet printing apparatus comprising:

an ink jet printing head as claimed in claim 3 for carrying out the printing operation on a printing surface of a printing medium;

printing head moving means for relatively moving said ink jet printing head relative to the printing surface of the printing medium; and a control section for operating said printing head moving means to relatively move said ink jet printing head and operating said printing head to carry out the printing operation.

5. An electrothermal converting element board comprising:

an electrothermal converting element layer having a plurality of heat generating sections arranged on one straight line in correspondence to a plurality of liquid flowing paths, each having a liquid ejection opening for ejecting liquid used for a printing at one end thereof;

a common electrode layer connected to said plurality of heat generating sections of said electrothermal converting element layer, wherein said common electrode layer is formed via a first insulating layer beneath said plurality of heat generating sections of said electrothermal converting element layer;

an individual electrode layer electrically connected to at least one of said plurality of heat generating sections of said electrothermal converting element layer and formed, beneath said common electrode layer via a second insulating layer; and a base section that supports said electrothermal converting element layer, said common electrode layer and said individual electrode layer, wherein recesses engaged with one ends of partitioning wall members forming said liquid flowing paths are formed in a cover layer for covering said plurality of heat generating sections and said first insulating layer, said common electrode layer, said second insulating layer and said individual electrode layer are laminated in sequence beneath said heat generating sections.

6. An electrothermal converting element board as claimed in claim 5, wherein part of said individual electrode layer is formed on a side of one of said plurality of heat generating sections at a distance therefrom.

7. An electrothermal converting element board as claimed in claim 5, wherein said plurality of heat generating sections have heat generating capacities different from each other per unit time.

8. An electrothermal converting element board as claimed in claim 5, wherein there is further provided a protective layer for covering said plurality of heat generating sections of said electrothermal converting element layer, and said common electrode layer and said individual electrode layer, and a thickness of a portion of said protective layer covering said plurality of heat generating sections is smaller than that of a portion of said protective layer covering said individual electrode layer.

9. An electrothermal converting element board comprising:

an electrothermal converting element layer having a plurality of heat generating sections arranged on one straight line in correspondence to a plurality of liquid flowing paths, each having a liquid ejection opening for ejecting liquid used for a printing at one end thereof;

a common electrode layer connected to said plurality of heat generating sections of said electrothermal converting element layer, wherein said common electrode layer is formed via a first insulating layer beneath said plurality of heat generating sections of said electrothermal converting element layer;

an individual electrode layer electrically connected to at least one of said plurality of heat generating sections of said electrothermal converting element layer and formed, beneath said common electrode layer via a second insulating layer; and a base section that supports said electrothermal converting element layer, said common electrode layer and said individual electrode layer, wherein said plurality of heat generating sections have heat generating capacities different from each other per unit time and said first insulating layer, said common electrode layer, said second insulating layer and said individual electrode layer are laminated in sequence beneath said heat generating sections.

10. An electrothermal converting element board as claimed in claim 9, wherein part of said individual electrode layer is formed on a side of one of said plurality of heat generating sections at a distance therefrom.

11. An electrothermal converting element board as claimed in claim 9, wherein there is further provided a protective layer for covering said plurality of heat generating sections of said electrothermal converting element layer, and said common electrode layer and said individual electrode layer, and a thickness of a portion of said protective layer covering said plurality of heat generating sections is smaller than that of a portion of said protective layer covering said individual electrode layer.

12. An ink jet printing head comprising:

a liquid ejection member having a plurality of liquid flowing paths, each having a liquid ejection opening at one end thereof for ejecting liquid used for a printing;

an electrothermal converting element board having an electrothermal converting element layer having a plurality of heat generating sections arranged on one straight line in correspondence to a plurality of liquid flowing paths, each having a liquid ejection opening for ejecting liquid used for a printing at one end thereof, a common electrode layer connected to said plurality of heat generating sections of the electrothermal converting element layer, wherein said common electrode layer is formed via a first insulating layer beneath said plurality of heat generating sections of said electrothermal converting element layer, an individual electrode layer electrically connected to at least one of the plurality of heat generating sections of the electrothermal converting element layer and formed beneath said common electrode layer via a second insulating layer, wherein said first insulating layer, said common electrode layer, said second insulating layer and said individual electrode layer are laminated in sequence beneath said heat generating sections, a base section that supports said electrothermal converting element layer, said common electrode layer and said individual electrode layer; and a wiring board electrically connected to said electrothermal converting element board for supplying electric power to said common electrode layer of said electrothermal converting element board, wherein a recess engaged with one end of a partitioning wall member forming the liquid flowing path in said liquid ejection member is formed in a cover layer covering said plurality of heat generating sections.

13. An ink jet printing apparatus comprising:

an ink jet printing head as claimed in claim 12 for carrying out the printing operation on a printing surface of a printing medium;

printing head moving means for relatively moving said ink jet printing head relative to the printing surface of the printing medium; and a control section for operating said printing head moving means to relatively move said ink jet printing head and operating said printing head to carry out the printing operation.

14. An ink jet printing apparatus comprising:

an ink jet printing head as claimed in claim 12 for carrying out the printing operation on a printing surface of a printing medium;

printing head moving means for relatively moving said ink jet printing head relative to the printing surface of the printing medium; and a control section for operating said printing head moving means to relatively move said ink jet printing head and operating said printing head to carry out the printing operation.

15. An ink jet printing head comprising:

a liquid ejection member having a plurality of liquid flowing paths, each having a liquid ejection opening at one end thereof for ejecting liquid used for a printing;

an electrothermal converting element board having an electrothermal converting element layer having a plurality of heat generating sections arranged on one straight line in correspondence to a plurality of liquid flowing paths, each having a liquid ejection opening for ejecting liquid used for a printing at one end thereof, a common electrode layer connected to said plurality of heat generating sections of the electrothermal converting element layer, wherein said common electrode layer is formed via a first insulating layer beneath said plurality of heat generating sections of said electrothermal converting element layer, an individual electrode layer electrically connected to at least one of the plurality of heat generating sections of the electrothermal converting element layer and formed beneath said common electrode layer via a second insulating layer, wherein said first insulating layer, said common electrode layer, said second insulating layer and said individual electrode layer are laminated in sequence beneath said heat generating sections, a base section that supports said electrothermal converting element layer, said common electrode layer and said individual electrode layer; and a wiring board electrically connected to said electrothermal converting element board for supplying electric power to said common electrode layer of said electrothermal converting element board, wherein the plurality of heat generating sections are different in the heat generation capacity per unit time from each other.

16. An ink jet printing apparatus comprising:

an ink jet printing head as claimed in claim 15 for carrying out the printing operation on a printing surface of a printing medium;

printing head moving means for relatively moving said ink jet printing head relative to the printing surface of the printing medium; and a control section for operating said printing head moving means to relatively move said ink jet printing head and operating said printing head to carry out the printing operation.

* * * * *